US010258520B1

(12) United States Patent
Beltran

(10) Patent No.: US 10,258,520 B1
(45) Date of Patent: Apr. 16, 2019

(54) MOBILITY CRAWLER FOR USERS WHOM SUFFER FROM CEREBRAL PALSY

(71) Applicant: Henry Beltran, Miami, FL (US)

(72) Inventor: Henry Beltran, Miami, FL (US)

( * ) Notice: Subject to any disclaimer, the term of this patent is extended or adjusted under 35 U.S.C. 154(b) by 0 days.

(21) Appl. No.: 16/196,211

(22) Filed: Nov. 20, 2018

(51) Int. Cl.

| | |
|---|---|
| ***A61G 5/02*** | (2006.01) |
| ***A61G 5/10*** | (2006.01) |
| ***A61G 5/12*** | (2006.01) |
| ***A61H 3/04*** | (2006.01) |
| ***A63B 23/035*** | (2006.01) |
| ***A63B 23/04*** | (2006.01) |
| *A61H 3/00* | (2006.01) |

(52) U.S. Cl.
CPC ..... *A61G 5/02* (2013.01); *A61G 5/10* (2013.01); *A61G 5/1091* (2016.11); *A61G 5/121* (2016.11); *A61G 5/125* (2016.11); *A61H 3/04* (2013.01); *A63B 23/03516* (2013.01); *A63B 23/047* (2013.01); *A61H 2003/007* (2013.01); *A61H 2201/0157* (2013.01); *A61H 2201/1261* (2013.01); *A61H 2201/1604* (2013.01); *A61H 2201/1621* (2013.01); *A61H 2203/0468* (2013.01); *A63B 2208/0257* (2013.01); *A63B 2208/12* (2013.01)

(58) Field of Classification Search
CPC ..... A61G 5/02; A61G 5/121; A61G 5/124; A61G 5/125; A61G 5/10; A61G 5/1091; A61G 2200/14; A61H 2201/1607; A61H 2201/1616; A61H 2201/1621; A61H 2201/163; A61H 2203/0468
See application file for complete search history.

(56) References Cited

U.S. PATENT DOCUMENTS

| | | | | |
|---|---|---|---|---|
| 6,702,305 | B2 * | 3/2004 | Miles | B25H 5/00 280/32.5 |
| 2011/0227303 | A1 * | 9/2011 | Gering | B25H 1/04 280/32.6 |
| 2014/0333045 | A1 * | 11/2014 | Sananes | A61G 5/028 280/281.1 |

* cited by examiner

*Primary Examiner* — Bryan A Evans
(74) *Attorney, Agent, or Firm* — Ruben Alcoba, Esq.

(57) ABSTRACT

A crawler that allows a person whom suffers from cerebral palsy to move in an environment. The crawler has a weight bearing support portion that is at an angle of 5 to 15 degree from the frame of the crawler. The weight bearing porting defines a headrest support, an arm support, and a trunk support. The crawler also has a trunk restraint and a pair of thigh restraints to that will keep a person secured on the crawler.

7 Claims, 3 Drawing Sheets

MOBILITY CRAWLER FOR USERS WHOM SUFFER FROM CEREBRAL PALSY

BACKGROUND

The present invention is directed to a crawler that will allow a person whom suffers from cerebral palsy to move around an environment.

Cerebral palsy (CP) is a group of disorders that affect a person's ability to move and maintain balance and posture. CP is the most common motor disability in childhood. CDC estimates that an average of 1 in 323 children in the U.S. have CP.[1]

[1]Available at https://www.cdc.gov/ncbddd/ca/ndex.html, Centers for Disease Control and Prevention, Apr. 18, 2018—Cerebral palsy (CP), seen on Nov. 16, 2018.

Cerebral palsy (CP) is a group of disorders that affect a person's ability to move and maintain balance and posture. CP is the most common motor disability in childhood. Cerebral means having to do with the brain. Palsy means weakness or problems with using the muscles. CP is caused by abnormal brain development or damage to the developing brain that affects a person's ability to control his or her muscles.[2]

[2] Available at https://www.cdc.gov/ncbddd/cp/facts.html, Centers for Disease Control and Prevention, Basics About Cerebral Palsy, seen on Nov. 16, 2018.

The symptoms of CP vary from person to person. A person with severe CP might need to use special equipment to be able to walk or might not be able to walk at all and might need lifelong care.[3]

[3]Id.

The most common type of CP is spastic CP. Spastic CP affects about 80% of people with CP.[4]

[4]Id.

The present invention was conceived to help a child whom suffers from Spastic quadriplegia/quadriparesis.

Spastic quadriplegia/quadriparesis—Spastic quadriplegia is the most severe form of spastic CP and affects all four limbs, the trunk, and the face. People with spastic quadriparesis usually cannot walk and often have other developmental disabilities such as intellectual disability; seizures; or problems with vision, hearing, or speech.[5]

[5]Id.

The inventor of the present invention has a child whom suffers from spastic quadriplegia and loves his child very dearly.

During his child's development, he has grown to accept his child's ailment and has done everything possible to make his child's life as comfortable as can be based on the child's reality.

He realized that one of his greatest freedoms, while spending time with his child, was the freedom of mobility, however small or difficult the mobility may be.

Realizing that if he could somehow grant some mobility to his child, he believed that his child's life would be improved.

Based on his child's infirmity, he knew that the only way for him to give his child the freedom of mobility was to device a crawler in which his child could rest on the crawler and use his lower and sometimes upper limbs to move the crawler in whichever direction his child's body would allow movement.

For the foregoing reason there is a need for a crawler that will allow a person whom suffers from Cerebral Palsy to move within an environment.

SUMMARY

The present invention describes a crawler that will allow a person whom suffers from cerebral palsy to move within an environment.

The crawler has a weight bearing support portion that is at an angle of 5 to 15 degree from the frame of the crawler. The weight bearing porting defines a headrest support, an arm support, and a trunk support. The crawler also has a trunk restraint and a pair of thigh restraints to that will keep a person secured on the crawler.

The crawler's headrest support and arm support are slidebly mounted on the weight bearing portion. The headrest support and the arm support can be fixedly secured on the weight bearing portion by tightening means after the user of the crawler has been placed on the crawler.

The crawler is used by first placing the person suffering from cerebral palsy head down on the crawler so that the front of the head of he person rests on the headrest and the chest of the person rests on the trunk support. Then securing the trunk of the person via the trunk restraint. Lastly, securing the thighs of the person with the thigh restrains.

An object of the present invention is to allow a person whom suffers from cerebral palsy to move within an environment.

Another object of the present invention is to allow a caretaker of a person whom suffers from cerebral palsy to place a patient within a device that will allow the patient to be secured within the device, yet also allow the patient the freedom to move within an environment.

Yet another object of the present invention is to allow a person whom suffers from cerebral palsy to exert force with his limbs on a surface and thereby exercise his or he limbs.

Still another object of the present invention is to provide a person whom suffers from cerebral palsy with a device that will strengthen his or her core and increase muscle tone or development throughout the person's body.

DRAWINGS

These and other features, aspects, and advantages of the present invention will become better understood with regards to the following description, appended claims, and drawings where:

DESCRIPTION

Figure 1:
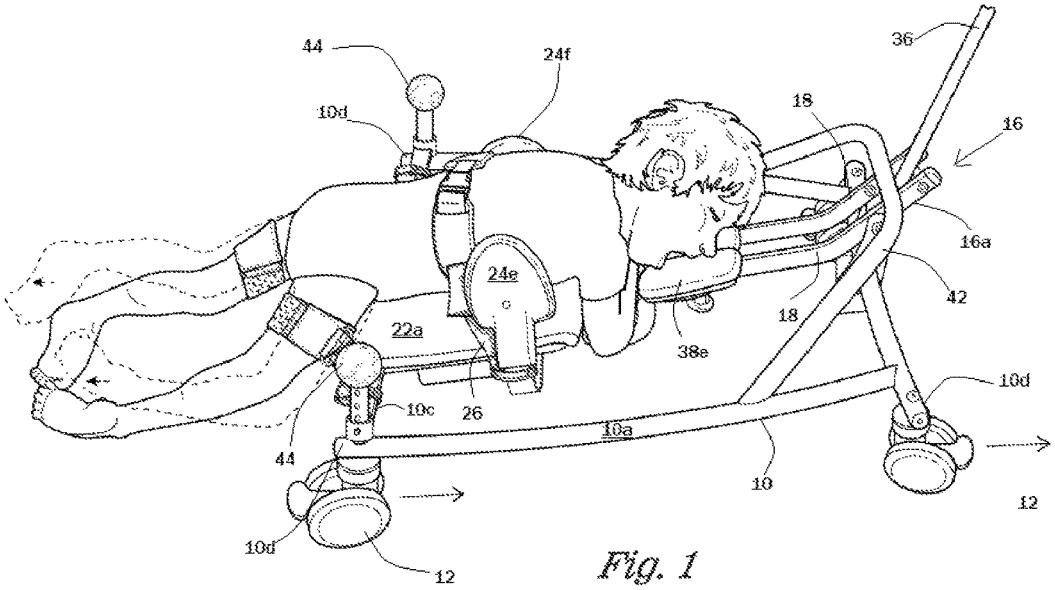
FIG. 1 is a perspective view that shows a person on the present invention.
Figure 2:
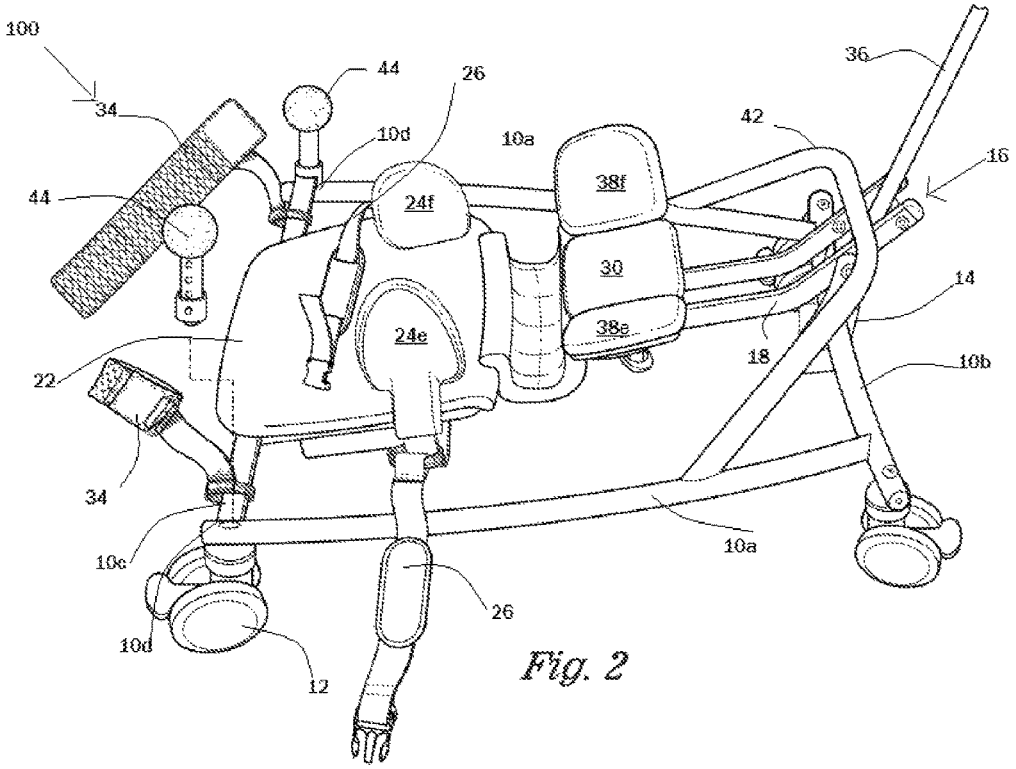
FIG. 2 is a perspective view of the present invention wherein the person is not on the crawler.
Figure 3:
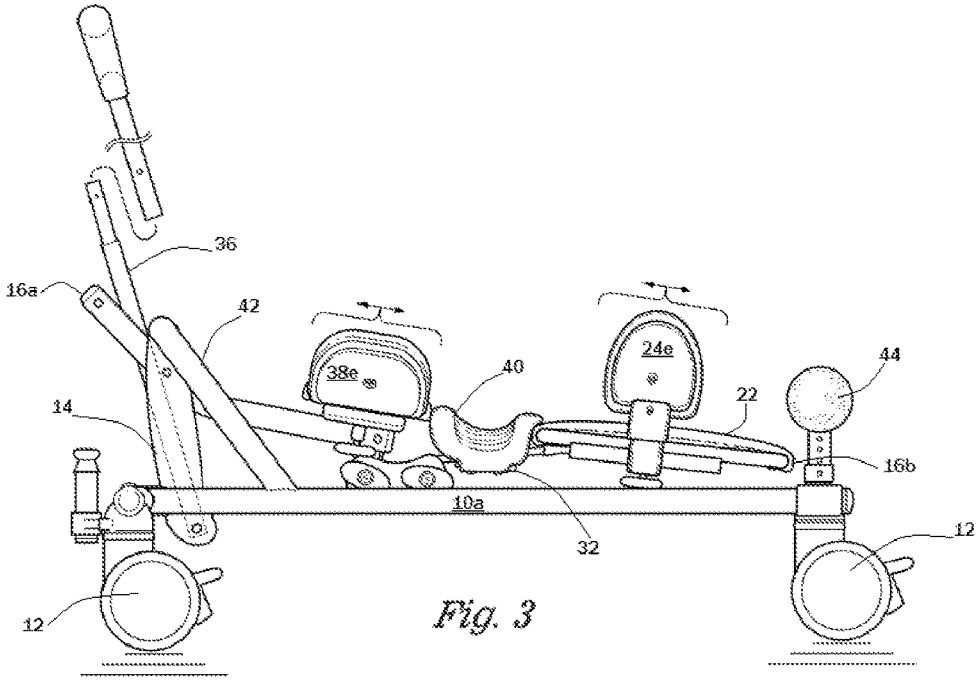
FIG. 3 is a side view of the present invention.
Figure 4:
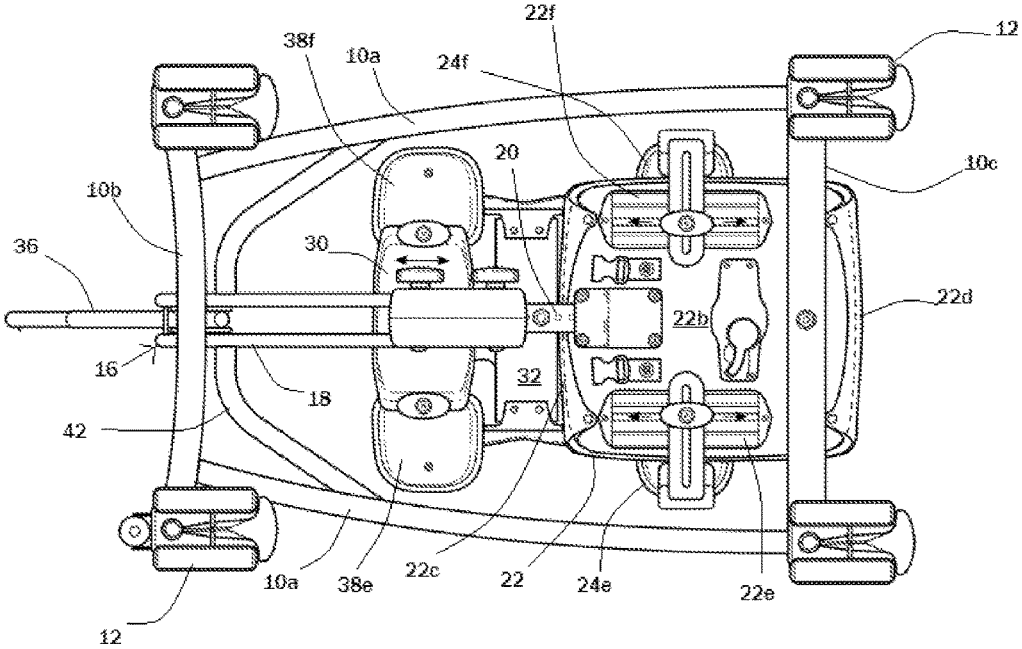
FIG. 4 is a bottom plan view of the present invention.

As seen in FIGS. 1-4, the present invention describes a crawler 100 that will allow a person whom suffers from cerebral palsy to move within an environment. The crawler 100 comprises of a four-sided frame 10 that has two lateral side bars 10*a* and a front 10*b* and a rear side 10*c* bar, four wheels 12, each wheel 12 is attached to a corner of the four-sided frame 10. A gooseneck 14 is centrally mounted and attached to the front bar 10*b*. A weight bearing support 16 that has a front 16*a* and a rear side 16*b*, the front of the weight bearing support 16*a* defines two attachment bars 18 that attach to the gooseneck 14, a central bar guide 20 that attaches to the two attachment bars 18, a trunk support 22 that has a top 22*a*, a bottom 22*b*, a front 22*c* and a rear side 22*d* wherein a front bottom side of the trunk support 22 is attached to the central bar guide 20 and a rear bottom side 22*d* of the trunk support 22 is attached to the rear side bar 10*c* of the frame 10, the bottom of the trunk support 22*b* defines a left 22*e* and a right guide rail 22*f*, the weight bearing support 16 is attached to the four-sided frame 10 so that an angle is created, from the rear of the four sided frame 10, of between five to fifteen degree. A left 24*e* and a right trunk restraint 24*f*, the left trunk restraint 24*e* is slidebly secured within the left guide rail 22*e* of the trunk support 22 and the right trunk restraint 24*f* is slidebly secured within the right guide rail 22*f*. A trunk restraining belt attachment 26 is attached to the trunk support 22. A headrest 30 that is slidebly mounted on the front side of the weight bearing support 16. And, an arm support 32 that is mounted on the central bar guide 20 at a position that is between the headrest 30 and the trunk support 22.

The crawler 100 may also comprise a set of thigh restraints 34 that are mounted on the rear side bar 10*c*. The thigh restraints 34 are used to keep the person that is placed on the crawler 100 from slipping off the crawler 100.

In an embodiment of the present invention, the crawler 100 has a pull bar 34 that is mounted on the gooseneck 14. The pull bar 34 allows a caregiver the ability to move the crawler 100 in an environment.

In another embodiment, the crawler 100 further comprises of a left 38*e* and a right adjustable wing 38*f* that attaches to the headrest 30. The left 38*e* and right adjustable 38*f* wings ensure that the person's head placed on the headrest 30 of the present invention does not slip of the headrest 30.

In still a further embodiment, the crawler has a gelpad 40 that is removably attached to the arm support 32. The gelpad 40 of the present invention protects the arms of the user that is placed on the invention.

In yet still a further embodiment, the crawler 100 has a u-shaped arm rest 42 that is attached to the lateral guides 10*a* so that the u-shaped arm rest 42 is above and before the headrest 30. The u-shaped arm rest 42 allows the user of the present invention to rest his arms on the u-shaped arm rest 42 and it also allows the caregiver to lift the present invention.

In still another embodiment of the present invention, the crawler 100 comprises two rear pegs 40 and each peg 40 is attached to a rear corner 10*d* of the crawler 100. The pegs 40 prevent the user's thighs from coming of the lateral sides of the crawler.

An advantage of the present invention is that it allows a person whom suffers from cerebral palsy to move within an environment.

Another advantage of the present invention is that it allows a caretaker of a person whom suffers from cerebral palsy to place a patient within a device that allows the patient to be secured within the device, yet also allows the patient the freedom to move within an environment.

Yet another advantage of the present invention is that it allows a person whom suffers from cerebral palsy to exert force with his limbs on a surface and thereby exercise his or her limbs.

Still another advantage of the present invention is that it provides a person whom suffers from cerebral palsy with a device that strengthens his or her core and increases muscle tone or development throughout the person's body.

While the inventor's above description contains many specificities, these should not be construed as limitations on the scope, but rather as an exemplification of several preferred embodiments thereof. Accordingly, the scope should not be determined by the embodiments illustrated, but by the appended claims and their legal equivalents.

What is claimed is:

1. A crawler that allows a person whom suffers from cerebral palsy to move in an environment, the crawler comprises:

a four-sided frame that has two lateral side bars and a front and a rear side bar, four wheels, each wheel is attached to a corner of the four-sided frame;

a gooseneck is centrally mounted and attached to the front bar;

a weight bearing support that has a front and a rear side, the front of the weight bearing support defines two attachment bars that attach to the gooseneck, a central bar guide that attaches to the two attachment bars, a trunk support that has a top, a bottom, a front and a rear side wherein a front bottom side of the trunk support is attached to the central bar guide and a rear bottom side of the trunk support is attached to the rear side bar of the frame, the bottom of the trunk support defines a left and a right guide rail, the weight bearing support is attached to the four-sided frame so that an angle is created, from the rear of the four sided frame, of between five to fifteen degree;

a left and a right trunk restraint, the left trunk restraint is slidebly secured within the left guide rail of the trunk support and the right trunk restraint is slidebly secured within the right guide rail;

a trunk restraining belt attachment is attached to the trunk support;

a headrest that is slidebly mounted on the front side of the weight bearing support; and an arm support that is mounted on the central bar guide at a position that is between the headrest and the trunk support.

2. The crawler that allows a person whom suffers from cerebral palsy to move in an environment of claim 1, the crawler comprises a set of thigh restraints that are mounted on the rear side bar.

3. The crawler that allows a person whom suffers from cerebral palsy to move in an environment of claim 2, the crawler comprises a pull bar that is mounted on the gooseneck.

4. The crawler that allows a person whom suffers from cerebral palsy to move in an environment of claim 3, the crawler comprises a left and a right adjustable wing that attaches to the headrest.

5. The crawler that allows a person whom suffers from cerebral palsy to move in an environment of claim 4, the crawler comprises a gelpad that is removable attached to the arm support.

6. The crawler that allows a person whom suffers from cerebral palsy to move in an environment of claim 5, the crawler comprises a u-shaped arm rest that is attached to the lateral guides so that the u-shaped arm rest is above and before the headrest.

7. The crawler that allows a person whom suffers from cerebral palsy to move in an environment of claim 5, the crawler comprises two rear pegs and each peg is attached to a rear corner of the crawler.

* * * * *